United States Patent [19]

Rebel

[11] 4,233,899

[45] Nov. 18, 1980

[54] PREVENTION OF IMPACT IN IMPRESSION CYLINDER OF SHEET-FED LITHOGRAPHIC PRESS

[75] Inventor: Herbert Rebel, Rodgau, Fed. Rep. of Germany

[73] Assignee: M.A.N.-Roland Druckmaschinenfabrik Faber & Schleicher AG, Fed. Rep. of Germany

[21] Appl. No.: 30,601

[22] Filed: Apr. 16, 1979

[30] Foreign Application Priority Data

Jun. 3, 1978 [DE] Fed. Rep. of Germany ..... 2824430

[51] Int. Cl.[3] ..... B41F 7/04; B41F 13/18

[52] U.S. Cl. ..... 101/142; 101/216; 101/409; 101/246

[58] Field of Search ..... 101/216, 217, 218, 219, 101/378, 415.1, 246, 375, 376, 409, 136, 137, 138–140, 141, 142, 143–145, 153, 154, 174, 177; 271/272–274

[56] References Cited

U.S. PATENT DOCUMENTS

| | | | |
|---|---|---|---|
| 1,040,012 | 10/1912 | Raabe | 271/274 |
| 2,447,991 | 8/1948 | Stempel | 101/217 |
| 3,395,638 | 8/1968 | Kirkus et al. | 101/216 |
| 3,732,813 | 5/1973 | Singh et al. | 101/216 |
| 4,018,158 | 4/1977 | Borneman | 101/415.1 X |

FOREIGN PATENT DOCUMENTS

| | | | |
|---|---|---|---|
| 1231259 | 12/1966 | Fed. Rep. of Germany | 101/415.1 |
| 1235334 | 3/1967 | Fed. Rep. of Germany | 101/415.1 |
| 1636312 | 3/1971 | Fed. Rep. of Germany | 101/415.1 |
| 2649052 | 6/1978 | Fed. Rep. of Germany | 101/217 |
| 1367860 | 6/1964 | France | 101/415.1 |

*Primary Examiner*—J. Reed Fisher

*Attorney, Agent, or Firm*—Leydig, Voit, Osann, Mayer & Holt

[57] ABSTRACT

A lithographic sheet-fed press having an impression cylinder with a gap formed in the surface thereof and having a cooperating blanket cylinder having bearers at its ends. A pair of auxiliary short bearer members bridge the gap in the impression cylinder, presenting arcuate edges for engagement with the bearers on the blanket cylinder, the bearer members are arranged at such radial height that when the blanket cylinder rolls into the region of the gap the force of printing pressure between the cylinders is taken over by the auxiliary bearer members to maintain the transaxial pressure between the cylinders substantially constant throughout the revolution thereby avoiding the cyclical impact accompanying sudden build-up of printing pressure at the end of the gap. The bearer members are guided for adjusting movement in a generally radial direction along precisely parallel paths to achieve corresponding settings to preserve the condition of constant pressure upon making a change in the thickness of the sheet stock being printed.

12 Claims, 4 Drawing Figures

PREVENTION OF IMPACT IN IMPRESSION CYLINDER OF SHEET-FED LITHOGRAPHIC PRESS

Figure 1:
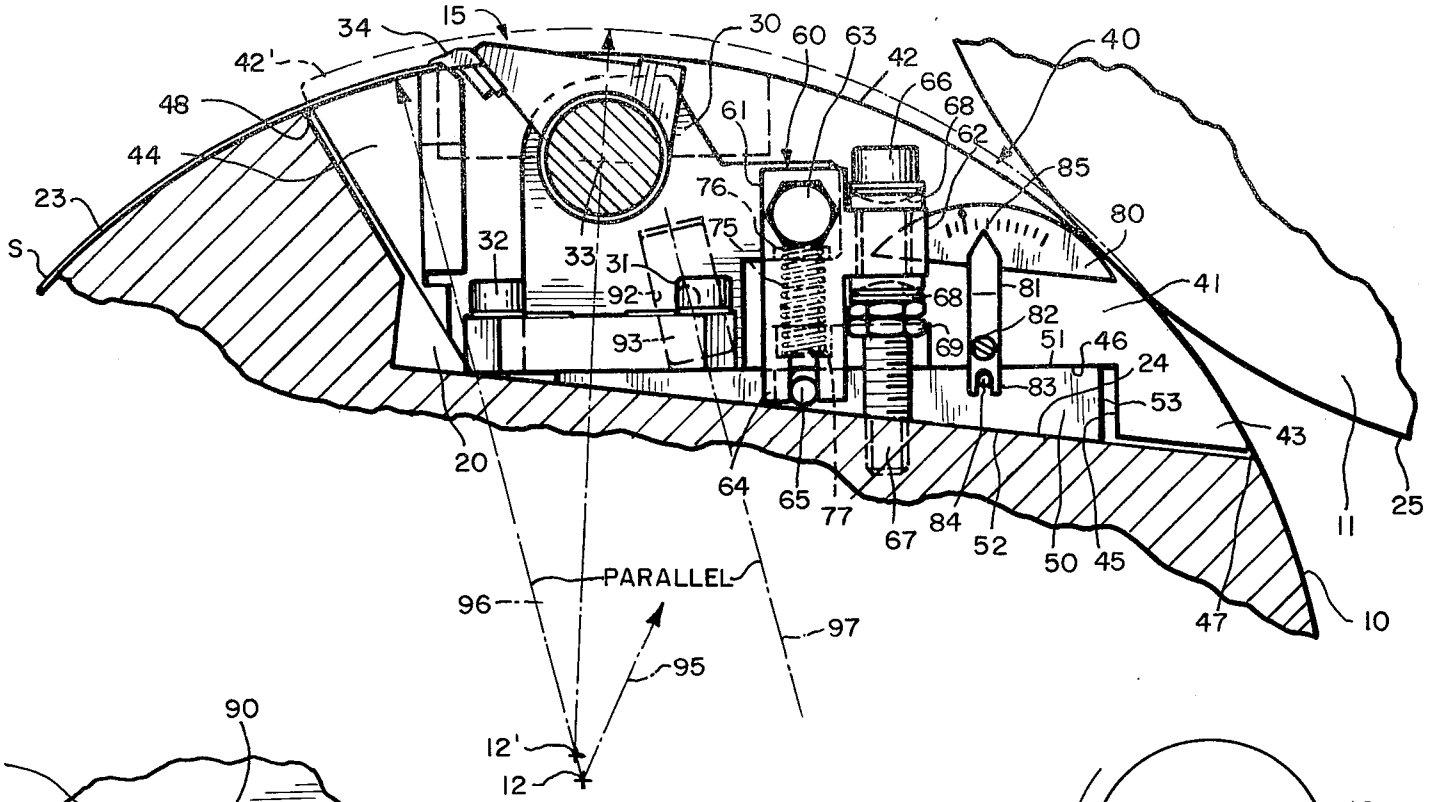

In a lithographic printing press in which there is the usual gap in the impression cylinder for accommodating the gripper structure, the cylinders, by reason of packing, develop transaxial printing pressure between them. When the cylinders rotate into a position in which the blanket cylinder is opposite the gap, there is loss of support, the blanket cylinder, so to speak, falling into the gap. A brief moment later when the blanket cylinder engages the printing area at the opposite end of the gap there is a sudden build-up of printing pressure resulting in cyclical impact between the cylinders. Such cyclical impact is particularly disadvantageous in high speed machines resulting in vibration and noticeable "leading edge" streaks on the printed material.

Many efforts have been made in the past to avoid this problem. For example in German publication D-OS 1,636,312 a shock absorber, in the form of a cushion at the end of the gap, is provided to cushion the impact and to damp the resulting cylinder movement. However, with a device of this type the arc which is available for restoration of printing pressure is, particularly in the case of a high speed press, too short to be effective.

It has been proposed to provide bearers between the cylinders, bearers which are cushioned by compression springs as covered in U.S. Pat. No. 1,040,012. However, use of such springs may lead to aggravated cylinder vibration with resulting impairment of the printed result. Attempts have also been made to employ rigid bearers on the blanket and impression cylinders, but rigid bearers cannot be used for several reasons. In the first place they cannot satisfactorily accommodate different thicknesses of stock. In addition the bearers must be relatively backed off to permit the development of printing pressure in the printing area; thus there remains a tendency for impact to occur at the end of the gap at the point of restoration of printing pressure.

It is, accordingly, an abject of the invention to provide, in a lithographic printing press, an impression cylinder having the usual gap for accommodation of gripping structure but which avoids the cyclical impact which has resulted from the use of gaps in the past. Conversely it is an object to provide an impression cylinder construction, including a gap, but in which the transaxial pressure, between the impression cylinder and its associated blanket cylinder, required to achieve a printed impression, remains substantially constant throughout each revolution. It is, in other words, an object of the invention to provide means for temporarily supporting the cooperating blanket cylinder in the region of the gap, that is, to temporarily take over the printing pressure, so that there is no necessity for sudden restoration or build-up of printing pressure when the printing area at the end of the gap is reached by the blanket cylinder.

It is, more specifically, an object of the invention to provide, on the impression cylinder, auxiliary bearer members presenting arcuate edges arranged to bridge the gap and cooperating with bearers on the blanket cylinder to prevent the blanket cylinder from falling into the gap during each revolution.

It is another object of the invention to provide anti-impact means for an impression cylinder which not only maintains transaxial pressure between the cylinders substantially constant but which is, in addition, easily and quickly adjustable to preserve the condition of constant pressure upon making a change in the thickness of the sheet stock being printed.

It is yet another object to provide an anti-impact means for an impression cylinder which is suitable for use with a wide range of thickness of sheet stock, all of the way from extremely thin sheets to cardboard, and which is calibrated at each end of the cylinder to provide reproducible settings for various thicknesses of stock and to insure identical settings at each end.

It is a specific object of the invention to provide anti-impact means in the form of auxiliary bearer members which bridge the gap in the impression cylinder and which, although radially adjustable, are nevertheless solidly seated with respect to the cylinder body in all conditions of adjustment.

It is a more specific object to provide an anti-impact arrangement for an impression cylinder which is not only easy to adjust on an accurately reproducible basis but which is inherently durable and extremely simple utilizing shallow wedges interposed between the auxiliary bearer members together with means for changing the degree of insertion of the bearer wedges in accordance with the thickness of the stock being printed.

In one of the aspects of the invention it is an object to provide an anti-impact assembly employing auxiliary bearer members presenting arcuate edges which are eccentric with respect to the cylinder surface so that any minor drop in transaxial pressure which may occur when the blanket cylinder encounters the gap is progressively restored over the entire arc of the gap for full application of printing pressure when the printing area is encountered at the end of the gap.

Figure 2A:
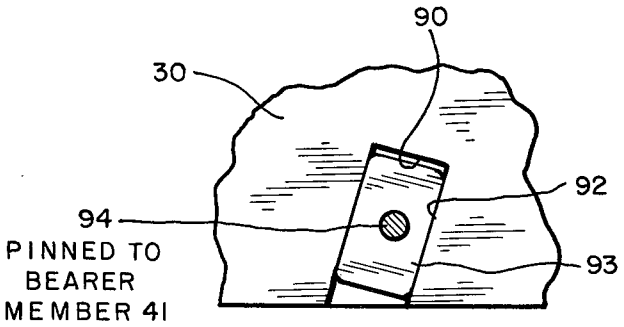
Figure 2:
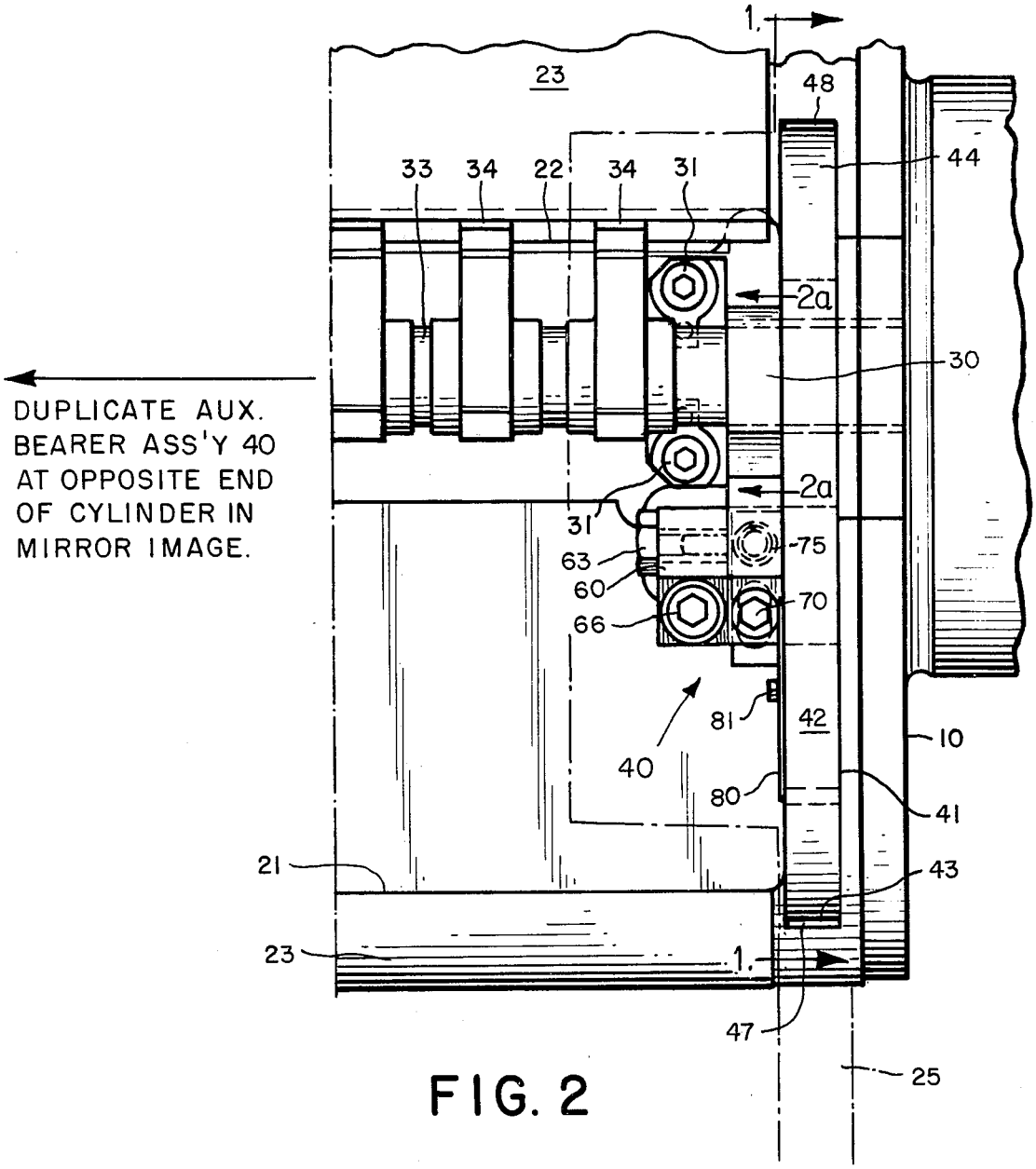

Other objects and advantages of the invention will become apparent upon reading the attached detailed description and upon reference to the drawings in which:

FIG. 1 is a cross section taken through an impression cylinder constructed in accordance with the present invention, specifically along the line 1—1 in FIG. 2.

Figure 1A:
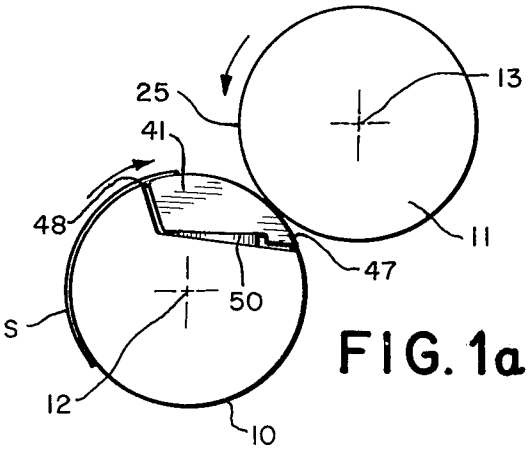

FIG. 1*a* is a fragmentary diagram at a reduced scale showing a blanket cylinder having bearers and in rolling engagement with the impression cylinder.

FIG. 2 is a fragmentary top view of the structure shown in FIG. 1.

FIG. 2*a* is a fragmentary axial section along line 2*a*—2*a* in FIG. 2 and showing the orientation of the way surfaces.

While the invention has been described in connection with a preferred embodiment, it will be understood that there is no intention to limit the invention to the embodiment shown but it is, on the contrary, the intention to cover alternative and equivalent forms of the invention included within the spirit and scope of the appended claims.

Turning now to FIGS. 1 and 1*a* there is shown a printing couple in the form of an impression cylinder 10 in rolling engagement with a blanket cylinder 11, the two cylinders being rotatable about their axes 12, 13, respectively. For gripping the leading edge of a sheet, indicated at S, a gripper assembly 15 is provided on the impression cylinder, nested in a gap 20. The gap, which extends lonitudinally along the cylinder has ends 21, 22, which define the respective limits of the printing area 23, as well as a flat bottom 24. For reasons which will become clear, the blanket cylinder 11 has rigid bearer rings 25 at its ends, such rings being commonly referred to as "bearers".

The gripper assembly 15 will be understood to be conventional, and it will suffice to say that it includes a pair of bearing blocks 30 adjacent the respective ends of the cylinder and which are seated on the bottom surface 24 of the gap, being held in place by mounting screws 31, 32. The bearing blocks 30 support a longitudinally extending shaft 33 carrying a series of grippers 34.

In accordance with the present invention there is, at each end of the impression cylinder, an auxiliary bearer assembly including an auxiliary bearer member arranged to bridge the gap, with means for supporting the member at such radial height that when the blanket cylinder rolls into the region of the gap the force of printing pressure between the cylinders is temporarily taken over by the auxiliary bearer member so that transaxial pressure between the cylinders is maintained substantially constant throughout the revolution. This avoids the usual cyclical impact accompanying sudden build-up of printing pressure at the end of the gap and at the beginning of the printing area. The impression cylinder includes means for guiding the bearer members in a generally radial direction along precisely parallel paths, with adjusting means for reproducibly adjusting the radial positions of the bearer members to precisely corresponding points to preserve the condition of constant pressure upon making a change in thickness of the sheet stock being printed.

Thus, referring to FIGS. 1 and 2, there is shown, in somewhat simplified form, an auxiliary bearer assembly 40 at one end of the impression cylinder 10, it being understood that there is a similar auxiliary bearer assembly, in mirror image, at the opposite end of the cylinder but which has been omitted for the sake of simplifying the showing. The assembly 40 includes a short auxiliary bearer member 41 presenting an arcuate outer edge 42 of the same curvature as the surface of the cylinder and which extends across the gap 20 in bridging relation. The auxiliary bearer member has a leading end 43 and a trailing end 44. The underside of the bearer member is recessed as indicated at 45, with the bottom surface 46 of the member being perfectly flat. The auxiliary bearer member 41 is alined with the corresponding bearer 25 on the blanket cylinder (see FIG. 2).

It is one of the features of the invention that the ends 43, 44 of the auxiliary bearer members slightly overlap the end edges 21, 22 of the gap, respectively. For nestingly accommodating the ends of the bearer member, conforming recesses 47, 48 (see FIG. 2) are provided in the cylinder body. As will be seen, the effect of the overlapping of the gap is to provide arcuately distributed regions of transition between the printing and non-printing condition.

In carrying out the present invention, adjusting means are provided for adjusting the radial positions of the bearer members 41. This is accomplished by interposing shallow wedges 50 between the bottom surface 46 of the respective bearer members and the bottom surface 24 of the groove, together with means for determining the degree of insertion of the wedges. As shown in FIG. 1, the wedge 50 has top and bottom surfaces 51, 52 and an end surface 53. For controlling the degree of insertion an adjusting assembly is used including a lever 60 of "L" shape having a radially extending arm 61 and a short horizontally extending arm 62, the lever being centrally pivoted to the bearing block 30 upon an axially extending screw 63. The longer, radially-extending arm is captively connected to the wedge 50. This is accomplished by providing a fork 64 at the lower end of the arm having parallel tines which snugly straddle a pin 65 mounted in the side wall of the wedge.

For the purpose of adjusting the angular position of the lever 60, an adjusting screw, or set screw, is interposed between the short lever arm and the cylinder body. Such set screw, indicated at 66, has an end 67 which is screwed into a threaded hole formed in the lower surface 24 of the gap. To permit relative cocking of the lever arm 62 with respect to the screw as the screw is adjustably rotated in one direction or the other, spherical sockets 68 are interposed on the upper and lower sides of the arm 62. The arm is snugly held captive between the sockets by means of a pair of lock or jam nuts 69 which have a clamping effect. Additional clamping may be obtained by use of a separate clamping screw 70 which, upon tightening, presses downwardly upon the wedge.

It will thus be apparent that by rotating the screw 66 in the clockwise direction, with screw 70 released, the lever 16 will be rocked counterclockwise to increase the degree of insertion of the wedge and hence the degree of projection of the bearer member 41, while rotating the screw 66 in the opposite direction serves to rock the lever 60 clockwise for retraction of the wedge. To insure that the auxiliary bearer member 41 is kept seated upon the wedge as it retracts, a coil type compression spring 75 is provided having an upper end 76 which is seated with respect to the cylinder structure and a lower end 77 which is in inward pressing engagement with the bearer member.

In accordance with one of the features of the invention a calibrated indicator is provided for indicating the degree of insertion of each wedge and hence the degree of radial extension of the bearer member. In the present instance this is accomplished by a calibrated scale 80 having a pointer 81 which is centrally pivoted to the bearer member at a pivot point 82 and which has, at its lower end, a fork 83 which captively engages a pin 84 mounted in the side wall of the wedge. The calibrated scale preferably has a reference position 85, which may correspond to the most common thickness of sheet, with accurate calibrations both above and below this level. The scale and pointer not only insure that wedges 50 at each end of the cylinder are inserted to equal degree but they provide convenient means for reproducibly adjusting the radial positions of the bearer member for different known thicknesses of sheet stock. In short, the same scale setting is employed each time paper stock of a certain thickness is used, assuming the conditions of packing remain the same.

In accordance with a still further aspect of the present invention means including way surfaces, interposed between the cylinder and the bearer members 41, are provided for guiding the bearer members in a generally radial direction along precisely parallel paths. In accordance with a more detailed aspect of the present invention the way surfaces are oriented substantially parallel to a radial line intersecting the trailing portion of the bearer members so that the presented arcuate edges of the bearer members are slightly eccentric with respect to the cylinder. Preferably, and as shown in FIG. 2*a*, a shallow groove 90 having way surfaces 91, 92 is formed in the wall of the bearing block 30 which is adjacent the bearer member 41. Sungly slidable in the groove is a block 93 which is secured to the bearer member by any suitable means, for example, by a pin 94 fixed in the wall of the bearer member. The angling of the way surfaces 91, 92, acting upon the block 93, thus determines the path of inward and outward adjusting movement of the bearer member. Where it is desired to produce equalized outward movement at both ends of the bearer member 41, the way surfaces may be oriented substantially parallel to a radial line intersecting the center of the bearer member, such a line being indicated at 95. However, preferably, and in accordance with one of the more detailed features of the present invention, the way surfaces are oriented substantially parallel to a radial line which intersects the trailing portion of each bearer member so that the presented arcuate edges 42 of the bearer members are slightly eccentric with respect to the surface of the cylinder. This condition can be illustrated by a geometrical construction based upon FIG. 1: A radial line 96 is first drawn to intersect the leading edge portion of the bearer member 41, and the line of orientation of the ways 91, 92, and which is indicated at 97, is made parallel to it. As a result, when the adjusting set screw 66 is turned (clockwise) in a directin to increase the degree of insertion of the wedge 50 to cam the bearer member outwardly, the motion of the bearer member must take place in the direction of the way surfaces, with the center of the presented arcuate surface 42 thereof moving from the cylinder axis 12 to a new point 12'. This causes the bearer member 41 to shift so that its outer edge surface 42 occupies a new position 42', the amount of the movement being exaggerated for the sake of clarity. It will be apparent upon inspection that the new locus of the bearer member 42' is eccentric with respect to the cylinder, with noticeable relative motion taking place at the trailing end 44 but with a relatively small amount of radial movement occurring at the leading end 43. The effect is to produce non-symmetrical conditions at the respective ends of the bearer members. With the way surfaces oriented as shown, a condition will exist in which there is limited release of printing pressure as the blanket cylinder reaches the end of the printing area but with the bearers 25 of the blanket cylinder thereafter rolling "uphill" over the entire arc of the gap so that full printing pressure is developed by the time that the end of the gap, and the beginning of the printing area, has been reached. This provides amply sufficient time for printing pressure to be fully restored even at the highest operating press speeds.

It will be apparent from the above that the present invention has the effect of greatly reducing, and indeed obviating, impact at the trailing end of the gap or leading end of the printing area. As a printing cycle is completed, which is the condition illustrated in FIG. 1, the blanket cylinder 11, instead of "falling into" the gap, has its bearers 25, instead, continuously supported by the presented arcuate edge of the bearer member 41 which is in bridging relation to the gap. Thus the transaxial force between the rollers is sustained even though the rollers are not in printing condition as the gap is traversed. Printing pressure is, in effect, temporarily "taken over" by the bearer members without substantial reduction, and this force is sustained until the blanket cylinder rolls clear of the bearer members, past the trailing edge 22 (FIG. 2) of the gap, and onto the printing area 23. The slight degree of overlap of the ends of the bearer members with respect to the ends of the gap provide arcuately distributed regions of transition between the printing and non-printing conditions.

Where it is desired to run sheet stock of a different thickness, the desired smooth restoration of printing pressure may be preserved by correctively adjusting the two adjusting screws 66, one at each end of the impression cylinder, until the corresponding pointers 81 occupy positions on the associated scales 80 which are equal and which correspond to a setting which has been found by experience to be optimum for the particular thickness of stock, assuming that the packing conditions remain the same.

Disadvantages associated with the use of bearers in the past have been fully overcome: There is no tendency toward the vibration encountered where complete circular bearers cushioned by coil springs are used. Comparing the present structure with the use of sets of rigid bearers, the limits of stock thickness are greatly extended and cyclical impact is overcome to a much greater degree; indeed, by proper adjustment impact may be avoided completely.

It is one of the features of the construction that the bearing blocks 30, adjacent each end of the impression cylinder, in addition to mounting the rockable gripper shaft 33, cooperate with the respective bearer members, particularly in providing guidance and a mounting point for the adjusting means. It will be understood, however, that the term "bearing block" is intended to be a general term applicable to any supporting block and whether or not a shaft 33 is also supported.

I claim as my invention:

1. In a lithographic sheet-fed press having an impression cylinder with a gap in the surface thereof defining the printing area and a cooperating blanket cylinder having bearers at its ends, blankets on the cylinders establishing printing pressure therebetween as the cylinders rotate in engagement with one another, a pair of auxiliary short bearer members arranged to bridge the gap in the impression cylinder, said bearer member presenting arcuate edges alined for engagement with the respective bearers on the blanket cylinder, means for supporting the bearer members at such radial height on the impression cylinder that when the blanket cylinder rolls into the region of the gap on the impression cylinder upon reaching the end of the printing area the force of printing pressure between the cylinders is temporarily taken over by the auxiliary bearer members to achieve a smooth restoration of printing pressure upon reaching the end of the gap and at the beginning of the printing area thereby avoiding the cyclical impact accompanying sudden build-up of printing pressure, the impression cylinder including guiding means for guiding the bearer members in a generally radial direction along precisely parallel paths, and adjusting means for reproducibly adjusting the radial positions of the bearer members to precisely corresponding points along the parallel paths to preserve the smooth restoration of printing pressure upon making a change in the thickness of the sheet stock being printed.

2. In a lithographic sheet-fed press having an impression cylinder with a gap in the surface thereof defining the printing area and a cooperating blanket cylinder having bearers at its ends, blankets on the cylinders establishing printing pressure therebetween as the cylinders rotate in engagement with one another, a pair of auxiliary short bearer members arranged to bridge the gap in the impression cylinder, said bearer members presenting arcuate edges alined for engagement with the respective bearers on the blanket cylinder, means for supporting the bearer members at such radial height on the impression cylinder that when the blanket cylinder rolls into the region of the gap on the impression cylinder upon reaching the end of the printing area the force of printing pressure between the cylinders is taken over by the auxiliary bearer members in the region of the gap to maintain the transaxial pressure between the cylinders substantially constant throughout each revolution thereby avoiding the cyclical impact accompanying sudden build-up of printing pressure at the end of the gap and at the beginning of the printing area, the impression cylinder including guiding means for guiding the bearer members in a generally radial direction along precisely parallel paths, and adjusting means for reproducibly adjusting the radial positions of the bearer members to precisely corresponding points along the parallel paths to preserve the condition of constant pressure upon making a change in the thickness of the sheet stock being printed.

3. In a lithographic sheet-fed press having an impression cylinder with a gap in the surface thereof defining the printing area and a cooperating blanket cylinder having bearers at its ends, bearing blocks nested in the gap adjacent the ends thereof, blankets on the cylinders establishing printing pressure therebetween as the cylinders rotate in engagement with one another, a pair of auxiliary short bearer members arranged to bridge the gap in the impression cylinder, said bearer members lying adjacent the bearing blocks at the ends of the gap and presenting arcuate edges alined for engagement with the respective bearers on the blanket cylinder, means for supporting the bearer members at such radial height on the impression cylinder that when the blanket cylinder rolls into the region of the gap on the impression cylinder upon reaching the end of the printing area the force of printing pressure between the cylinders is temporarily taken over by the auxiliary bearer members to achieve a smooth restoration of printing pressure upon reaching the end of the gap and at the beginning of the printing area thereby avoiding the cyclical impact accompanying sudden build-up of printing pressure, the impression cylinder including guiding means interposed between the bearer members and the respective bearing blocks for guiding the bearer members in a generally radial direction along precisely parallel paths, and adjusting means interposed between the bearer members and the respective bearing blocks for adjusting the radial positions of the bearer members to corresponding points along the parallel paths, and means for clamping the adjusting means in adjusted position.

4. The combination as claimed in claim 1 or claim 2 in which the auxiliary bearer members have ends which slightly overlap the ends of the gap to provide arcuately distributed regions of transition between the printing and non-printing condition.

5. The combination as claimed in claim 1 or claim 2 in which the auxiliary bearer members have ends which overlap the ends of the gap and which are nested in conforming recesses flanking the printing area.

6. The combination as claimed in claim 1 or claim 2 in which the adjusting means includes shallow wedges interposed between the auxiliary bearer members and the bottom surface of the gap and in which the adjusting means further includes means for controlling and determining the degree of insertion of the wedges under the bearing members.

7. The combination as claimed in claim 1 or claim 2 in which the adjusting means includes shallow wedges interposed between the respective auxiliary bearer members and the bottom surface of the gap, each wedge having an adjustable lever coupled to the cylinder for adjusting the degree of insertion of the wedge.

8. The combination as claimed in claim 1 or claim 2 in which the adjusting means includes shallow wedges respectively interposed between the auxiliary bearer members and the bottom surface of the gap, each wedge having an associated adjusting lever, the adjusting lever being of "L" shape pivoted to the impression cylinder and having a generally radially extending arm coupled to the wedge and a second arm extending substantially at right angles thereto, the second arm being coupled to the cylinder by a set screw interposed between such arm and the cylinder for adjusting the angle of the lever and hence the degree of insertion of the wedge.

9. The combination as claimed in claim 1 or claim 2 in which the adjusting means includes shallow wedges interposed between the auxiliary bearer members and the bottom surface of the gap and in which the adjusting means further includes means for controlling and determining the degree of insertion of the wedges under the bearing members and in which there is associated with each wedge a calibrated scale having a cooperating movable pointer coupled to the wedge for constantly indicating the degree of insertion thereof and thereby the degree of radial extension of the respective auxiliary bearer members.

10. The combination as claimed in claim 1 or claim 2 in which the guiding means for guiding the bearer members in a generally radial direction along precisely parallel paths is in the form of respective parallel way surfaces interposed between the bearer members and the cylinder.

11. The combination as claimed in claim 1 or claim 3 in which the guiding means for guiding the bearer members in a generally radial direction along precisely parallel paths is in the form of respective parallel way surfaces interposed between the bearer members and the cylinder, the way surfaces being oriented substantially parallel to a radial line intersecting the trailing portion of the bearer members so that the presented arcuate edges of the bearer members are slightly eccentric with respect to the cylinder for progressive restoration of printing force over the arc of the gap.

12. The combination as claimed in claim 1 or claim 2 in which the adjusting means includes a shallow wedge interposed between each respective auxiliary bearer member and the bottom surface of the gap and in which each auxiliary bearer member has a spring coupled to the impression cylinder for maintaining each bearer member firmly bottomed on its associated wedge and each wedge firmly seated on the bottom surface of the gap.

* * * * *